US006120841A

United States Patent [19]

Parmentier et al.

[11] Patent Number: 6,120,841

[45] Date of Patent: Sep. 19, 2000

[54] METHOD OF MAKING AN ACTIVATED FABRIC OF CARBON FIBERS

[75] Inventors: Philippe Parmentier, Villeurbanne; Véronique Fontarnou, Meyzieu; Ludovic Ouvry, Chassieu, all of France

[73] Assignee: Messier-Bugatti, Villacoublay, France

[21] Appl. No.: 09/381,060

[22] PCT Filed: Mar. 12, 1998

[86] PCT No.: PCT/FR98/00504

§ 371 Date: Sep. 13, 1999

§ 102(e) Date: Sep. 13, 1999

[87] PCT Pub. No.: WO98/41678

PCT Pub. Date: Sep. 24, 1998

[30] Foreign Application Priority Data

Mar. 14, 1997 [FR] France ..... 97 03083

[51] Int. Cl.[7] ..... B05D 3/02; D01F 9/14; D01F 9/16; D01F 11/12

[52] U.S. Cl. ..... 427/227; 427/353; 427/381; 427/382

[58] Field of Search ..... 427/227, 353, 427/381, 382

[56] References Cited

U.S. PATENT DOCUMENTS

| | | | |
|---|---|---|---|
| 3,441,378 | 4/1969 | Didchenko . | |
| 3,479,151 | 11/1969 | Gutzeit . | |
| 3,529,934 | 9/1970 | Shindo . | |
| 3,661,503 | 5/1972 | Didchenko et al. | 23/209.1 |

FOREIGN PATENT DOCUMENTS

| | | |
|---|---|---|
| 50-006821 | 1/1975 | Japan . |
| 1301101 | 12/1972 | United Kingdom . |

OTHER PUBLICATIONS

Lai et al, ACS Symp. Ser. (1977), 48 (Cellul. Chem. Technol., Symp.), pp. 256–272.
Zakrzewska, Koks, Smola, Gaz (1981), 26(4), pp. 105–108.
Gavrilov, Khim. Drev. (1983), (2), pp. 23–26.
Derwent Abstract, AN 85–287343, JP 60 198 166A, Oct. 1985.
Derwent Abstract, AN 83–49756k, JP 57 167 716, Oct. 1982.
Derwent Abstract, AN 77–24525y, JP 52 025 120A, Feb. 1977.
Derwent Abstract, AN 89–169593, JP 01 111 022A, Apr. 1989.
Derwent Abstract, AN 96–299267, TW 274 567, Apr. 1996.
Derwent Abstract, AN 77–52947y, JP 52 070 121A, Jun. 1977.
Derwent Abstract, AN 78–22845a, JP 53 014 831 A, Feb. 1978.
Patent Abstract of Japan JP 55 010472A, Jan. 1980.
Derwent Abstrat, An 97–436057, CN 1 115 796A, Jan. 1996.

*Primary Examiner*—Erma Cameron
*Attorney, Agent, or Firm*—Weingarten, Schurgin, Gagnebin & Hayes LLP

[57] ABSTRACT

A fabric made of fibers of a carbon-precursor cellulose material is impregnated with a composition containing at least one inorganic ingredient having a function of promoting dehydration of cellulose, and the fabric is subjected to heat treatment. This treatment consists in raising temperature at a speed lying in the range 1° C./min to 15° C./min followed by keeping the temperature constant in the range 350° C. to 500° C., and it is followed by a step of washing the fabric. This produces directly an activated fabric of carbon fibers having a specific surface area of not less than 600 $m^2/g$, without subsequent activation treatment at a higher temperature.

12 Claims, 2 Drawing Sheets

METHOD OF MAKING AN ACTIVATED FABRIC OF CARBON FIBERS

This is the national stage of International Application No. PCT/FR98/00504, filed Mar. 12, 1998.

1. Field of the Invention

The present invention relates to making activated fabrics out of carbon fibers.

Such fabrics are usable in particular for filtering fluids, e.g. for processing gaseous or liquid waste.

2. Background of the Invention

Various methods are known for making carbon fiber fabrics starting from a cellulose fiber fabric which is impregnated with a liquid composition containing an ingredient whose function is to promote dehydration of the cellulose, prior to being subjected to heat treatment at a temperature which is high enough to transform the cellulose fibers essentially into carbon fibers.

Such ingredients that promote the dehydration of cellulose are also known as fire-proofing agents for cellulose. They enable the cellulose precursor to be carbonized with better efficiency and at a faster rate.

The making of an activated fabric out of carbon fibers then includes activation treatment of the carbon fiber fabric by the action of an oxidizing gas, e.g. carbon dioxide, water vapor, or air, at a temperature greater than 500° C., typically in the range 600° C. to 1000° C., i.e. at a temperature higher than the carbonizing temperature. A technique for activating a carbon fabric in an oven is described in document FR-A-2 741 363.

Reference can also be made to the following documents: "Database WPI, Derwent Publications Ltd.", London, 4B, No. AN96-299 267 (TW-A-274 567), No. AN77-52947Y (JP-A-52-070121), No. AN85-287 343 (JP-A-60-198 166), No. AN83-49756K (JP-1-56-167716), and "Patents Abstracts of Japan", Vol. 4, No. 38 (C-004) (JP-A-55-010472) which describe the activation of carbon fiber fabrics previously obtained by carbonizing a cellulose precursor to which there has been added a cellulose dehydration promoter (ammonium chloride, phosphoric acid, zinc chloride, . . . ).

Those activation techniques require special heat treatment. Their overall mass efficiency is relatively low compared with the cellulose fiber fabric, since the activation treatment has the effect of creating an array of micropores by eliminating carbon. Cost price is relatively high since the carbon fiber fabrics to which activation is applied are themselves expensive. In addition, activation has a major effect on the mechanical qualities of the carbon fibers, and it can be seen that the above-mentioned documents do not, in general, mention the mechanical properties of activated carbon fibers.

OBJECTS AND BRIEF SUMMARY OF THE INVENTION

An object of the present invention is to provide a method enabling activated fabrics of carbon fibers to be obtained starting from cellulose type carbon-precursor fibers, and to do so in a manner that is less expensive and with much greater efficiency than in the prior art.

Another object of the invention is to provide a method enabling activated fabrics of carbon fibers to be obtained having good strength and conserving a high degree of flexibility, enabling them to be shaped, e.g. by being draped.

The invention provides a method of making an activated fabric of carbon fibers, the method comprising the steps that consist in providing a fabric of fibers of a carbon-precursor cellulose material, impregnating the fabric with a composition containing at least one inorganic ingredient having a function of promoting dehydrating of cellulose, and performing heat treatment on the impregnated fabric at a temperature which is sufficient to cause the precursor cellulose to be transformed essentially into carbon, and obtaining a fabric of carbon fibers, which method is characterized in that the heat treatment consists in raising temperature at a speed lying in the range 1° C./min to 15° C./min followed by keeping the temperature constant in the range 350° C. to 500° C., and followed by a step of washing the fabric, thereby directly obtaining an activated fabric of carbon fibers having a specific surface area of not less than 600 $m^2/g$, without subsequent activation treatment at a higher temperature.

Thus, the invention is remarkable in that the carbonization and activation stages are performed in a single heat treatment stage, at a moderate temperature, giving rise to an activated fabric having very high specific surface area. In addition, its efficiency, measured as the ratio between the mass of the activated fabric and the mass of the initial cellulose fiber fabric, is greater than 30%, and typically lies in the range 35% to 45%, and is therefore high. Furthermore, as can be seen from the examples given below, it is possible to obtain activated fabrics of carbon fibers that conserve excellent strength.

The duration of the constant temperature heat treatment stage is preferably no greater than 1 h.

The heat treatment is performed under an atmosphere that is inert or partially oxidizing. The carbon-precursor cellulose material constituting the fibers of the starting fabric is selected from: rayons, spun viscose, solvent spun celluloses, cotton, and bast fibers; and preferably from textile rayons and spun viscose.

Also advantageously, the composition of the liquid for impregnating the fabric of cellulose material fibers contained at least one inorganic ingredient and solid fillers, e.g. selected from antimony, iron, titanium, and silicon.

Also advantageously, the steps of heat treatment and of washing are performed continuously on the fiber fabric, which is made possible by the good strength of the fabric.

BRIEF DESCRIPTION OF THE DRAWINGS

Implementations of the method are described below by way of non-limiting indication. Reference is made to the accommodating drawings, in which.

DETAILED DESCRIPTION OF THE PREFERRED IMPLEMENTATIONS

Figure 1A:
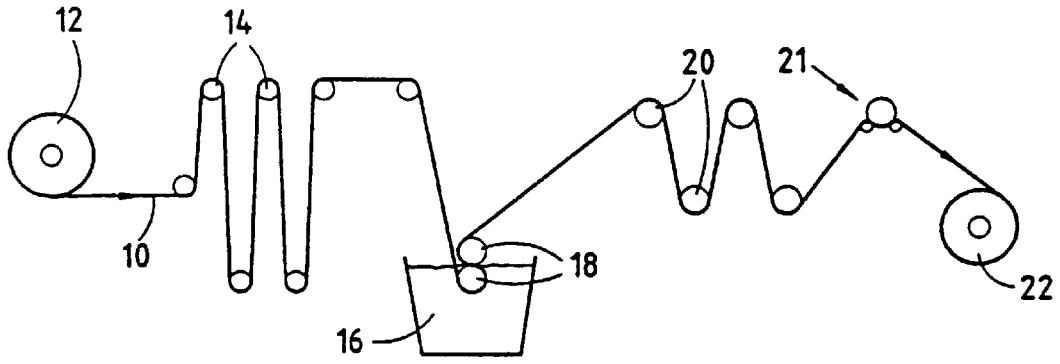
FIGS. 1A, 1B, and 1C are a highly diagrammatic representation of an industrial installation enabling the method to be implemented.

The method can be implemented using various fiber fabrics, in particular fabrics made of threads, tows, woven cloth, sheets of unidirectional or multidirectional threads, felts, mats, knits, sheets, films, . . . .

The starting fiber fabric is made of carbon-precursor fibers of the cellulose type, e.g. rayon multifilaments, spun viscous fibers (fibranne), fibers or filaments of solvent spun cellulose, cotton fibers, or indeed bast fibers.

As appears from the examples given below, in order to obtain an activated fabric of carbon fibers that presents good strength, it is preferable to use precursor fibers made of a cellulose material having a small degree of orientation and a small amount of crystallinity. It is then preferable to select textile rayon or spun viscose.

The cellulose fiber fabric is impregnated by a composition containing at least one ingredient whose function is to promote dehydration of the cellulose. Such ingredients are well known per se and at least some of them are also used as agents for fire-proofing cellulose. One or more inorganic compounds can be used selected from phosphoric acid ($H_3PO_4$), sulfuric acid ($H_2SO_4$), hydrochloric acid (HCl), dibasic ammonium phosphate ($(NH_4)_2HPO_2$), sodium phosphate ($Na_3PO_4$), potassium sulfate ($K_2SO_4$), ammonium chloride ($Na_4Cl$), zinc chloride ($ZnCl_2$), any salt of phosphorus or of boron, . . . , and in general Lewis acids or Brønsted acids.

A mixture of several ingredients can have a beneficial effect on the strength of the resulting final fabric by selecting the ingredients so as to promote cellulose dehydration at different moments in the heat treatment, and consequently causing the reaction to be less violent.

Various solid fillers can be added to the impregnation composition so as to provide impurities that enhance the development of arrays of micropores during the heat treatment. By way of example, it is possible to use particles of antimony, iron, titanium, or silicon. These heteroatoms occupy places between and/or within structural units of carbon during the formation of the carbon lattice, thereby increasing its microporosity.

The concentration of ingredient(s) for catalyzing dehydration of cellulose depends on the nature of the ingredients. As a general rule, concentration is selected to be high enough to generate a large specific surface area in the activated fabric, but without being excessive since that would lead to a fabric that is fragile (brittle) and rigid.

The heat treatment has a first stage during which temperature is caused to rise progressively, followed by a stage at which temperature is kept constant.

Temperature should rise fast enough to obtain a large specific surface area, but not too fast so as to ensure that the cellulose is degraded under controlled conditions, thereby obtaining a final activated fabric that has good strength. The average rate of temperature rise lies in the range 1° C./min to 15° C./min, and it is not necessary for temperature to increase in linear manner over time.

The final constant temperature portion of the heat treatment serves to finish off degrading the cellulose. Nevertheless, it is important not to exceed a maximum value beyond which it has been observed that there is a risk of the micropores closing. The final treatment temperature lies in the range 350° C. to 500° C.

The heat treatment (temperature rise followed by constant temperature) is performed under an inert atmosphere, e.g. nitrogen, or an atmosphere that is partially inert. With a partially inert atmosphere, the following may be present: oxygen from the air, carbon dioxide, water vapor, and other oxidizing agents, in particular agents generated by decomposition of the ingredients in the impregnation composition. In the constant temperature portion of the heat treatment, any air, carbon dioxide, or water vapor, that may be present, participates in decomposing the cellulose, but they do not behave as direct oxidants of carbon and they do not act as activation agents, as would be the case at temperatures that are much higher.

Final washing of the activated fabric is preferably performed immediately after the heat treatment so as to prevent the newly-created micropores becoming obstructed, which could otherwise arise because of excess ingredients of the impregnation composition crystallizing in the micropores. Immediate washing is important because the rate at which such crystals dissolve is very slow.

Washing performed in water can Include a first stage of solubilizing the ingredient(s) of the impregnation composition present in excess on the final fabric, followed by a second stage of rinsing. Washing makes it possible to eliminate not only the residual impregnation composition, but also to eliminate the products of degrading the carbon-precursor cellulose material.

Particular implementations of the method are described below.

EXAMPLE 1

Samples were used of woven rayon constituted by multifilament viscose having less than 0.03% oiling. The cloth was obtained from 190 tex threads woven in a 15×15 structure (i.e. 15 threads per cm in the warp direction and in the weft direction).

The cloth was baked at 120° C. for 1 hour in a ventilated dryer and then cooled for half an hour in a desiccator. The mass per unit area of the cloth was then 530 g/m$^2$.

A sample of the cloth was then soaked in an aqueous solution of phosphoric acid at 200 grams per liter (g/l) for 2 h, and then was drip-dried flat on a grid for at least 24 h. The acid content on the cloth was 17%, measured by the ratio between the mass of pure phosphoric acid on the cloth and the mass of the dry cloth prior to being impregnated.

The impregnated cloth was rolled up and placed in a ceramic boat that was inserted into a quartz tube of a heat treatment oven.

Heat treatment was performed under a flow of nitrogen at 10 liters per hour (1/h) at atmospheric pressure. The treatment comprised a rise in temperature at a speed of about 10° C./min up to 400° C., followed by keeping this temperature constant for 30 min.

After cooling, the cloth was washed so as to remove the products of degrading the cellulose of the initial precursor and/or any excess acid additive. Washing was performed by a flow of distilled water for 5 h, and the washed cloth was dried under air at 160° C. for 2 h.

The activated carbon fiber cloth that was finally obtained had the following remarkable characteristics:

high specific surface area, about 1000 m$^2$/g;

a mass per unit area of about 350 g/cm$^2$, after drying;

a good level of tensile strength, breaking at about 1 daN/cm, both in the warp direction and in the weft direction;

the pores of a mean diameter equal to about 0.6 nm;

the total pore volume of about 0.6 cm$^3$/g;

the carbon content of about 80%; and a mean efficiency of 40%, as obtained by measuring the ratio between the weight of the activated carbon fiber cloth as obtained over the weight of baked and dried rayon cloth (where such efficiency is more than twice that obtained with the prior art methods mentioned at the beginning of the description, in which activation is performed at a high temperature after carbonization).

The above example is reproduced in row A of Table 1 below.

EXAMPLES 2 to 12

The procedure was the same as in Example 1, but the concentration of phosphoric acid solution was varied, or the conditions of heat treatment were varied (speed of temperature rise, constant temperature, duration of constant temperature, optional addition of water vapor into the atmosphere under which heat treatment was performed).

Examples 2 to 12 are to be found in rows B to L of Table 1.

In this table, "acid content" is the ratio between the mass of pure acid fixed on the cloth after impregnation and the mass of dry cloth prior to impregnation, "efficiency" is the weight of the activated cloth made of washed and dried carbon relative to the weight of baked and dry rayon cloth, and traction strength is as measured in the warp direction or the weft direction on the resulting activated carbon cloth.

TABLE 1

| Activated cloth | Acid content % | Heat treatment | Efficiency % | Specific surface area $m^2/g$ | Traction strength daN/cm |
|---|---|---|---|---|---|
| A | 17 | 10° C./min 400° C., 1/2 h | 40.7 | 1040 | 0.9 |
| B | 17 | 10° C./min 500° C., 1/2 h | 39.5 | 690 | 0.8 |
| C | 17 | 10° C./min 600° C., 1/2 h | 42.3 | 260 | 1 |
| D | 17 | 10° C./min 400° C., 1/2 h + water vapor at 31% vol. | 39.4 | 985 | 0.45 |
| E | 17 | 10° C./min 500° C., 1/2 h + water vapor at 31% vol. | 36.5 | 930 | 0.85 |
| F | 17 | 1° C./min 400° C., 1/2 h | 42.5 | 870 | 2.6 |
| G | 17 | 6° C./min 400° C., 1/2 h | 41.6 | 910 | 0.55 |
| H | 17 | 15° C./min 400° C., 1/2 h | 33.7 | 1070 | 0.3 |
| I | 17 | 20° C./min 400° C., 1/2 h | 40.4 | 1065 | (brittle) |
| J | 25.5 | 10° C./min 400° C., 1 h | 40.3 | 1280 | (brittle) |
| K | 25.5 | 1° C./min 400° C., 1 h | 41.6 | 1095 | 0.76 |
| L | 34 | 10° C./min 400° C., 1 h | 39.7 | 1660 | (very brittle) |

The results observed show that the amount of acid fixed on the rayon cloth should preferably remain within limits, otherwise the strength of the activated carbon cloth becomes weak or even nil. Similarly, the heat treatment must be relatively moderate in terms of speed of temperature rise and in terms of the temperature and the duration of the constant-temperature portion. It should also be observed that the temperature of the constant portion should not exceed 500° C. if it is desired to guarantee a specific surface area that is relatively high, and in any event greater than 600 $m^2/g$.

In addition, the presence of water vapor in the atmosphere under which the heat treatment is performed makes it possible to increase specific surface area.

Example 13

Figure 1B:
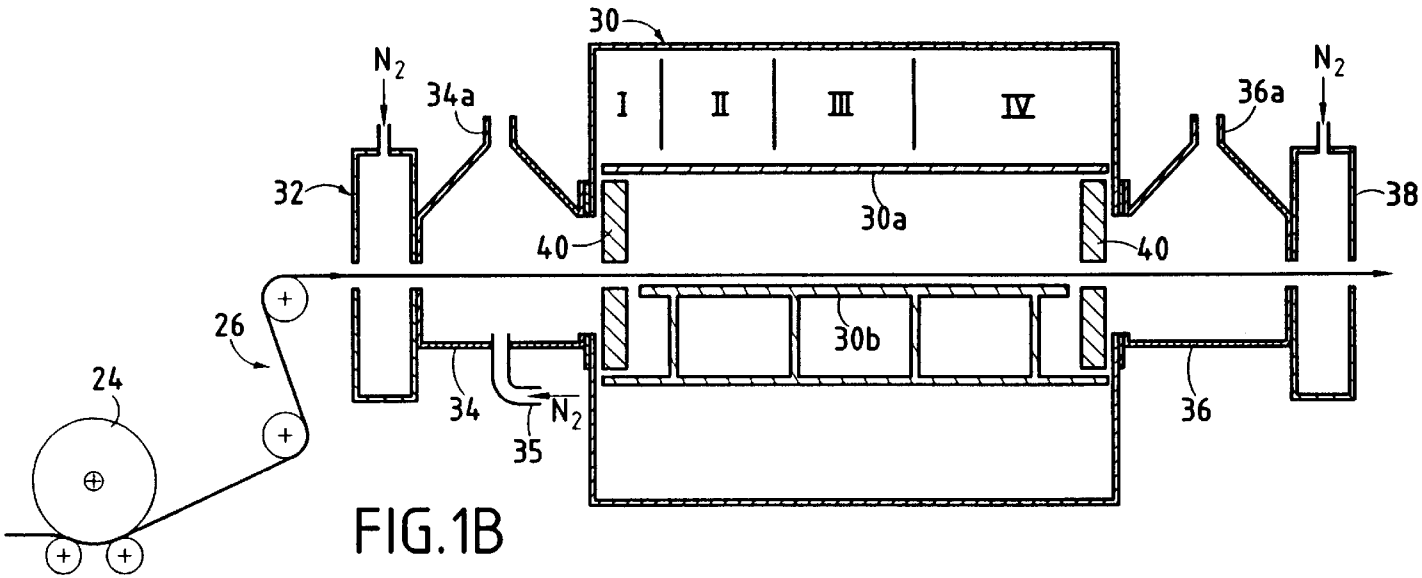
Figure 1C:
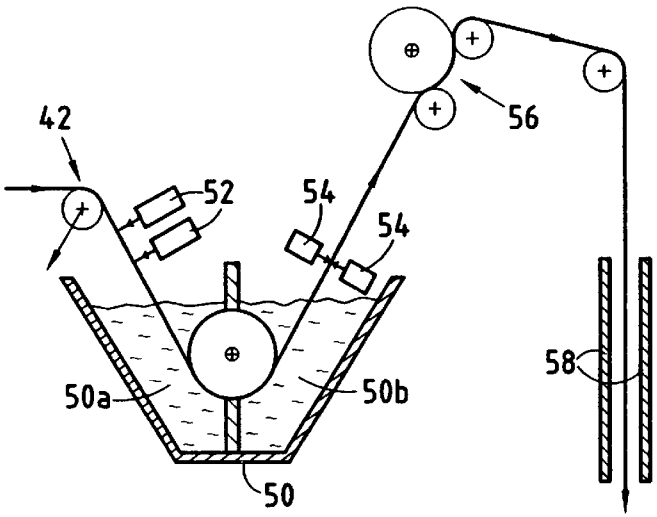

Semicontinuous processing was performed on rayon cloth by means of the installation shown very diagrammatically in FIGS. 1A, 1B, and 1C.

The starting material was a strip of textile rayon cloth 10 (FIG. 1A) based on viscose drawn from a reel 12. The cloth contained less than 0.03% oil, was 1000 mm wide, and had a weight per unit area when dry of about 530 $g/m^3$.

After being dried by passing over heater rolls 14 at a temperature of about 120° C., the cloth was impregnated using the padding technique with a composition containing a mixture of pure phosphoric acid (18% by weight), sodium phosphate (2% by weight), and sodium borate (1.5% by weight), the remainder being water. The cloth was conveyed through a vessel 16 containing the composition, and was then wrung out between two rolls 18 pressed against each other at a pressure adjusted to about 2 bars. The travel speed of the strip of cloth was about 0.5 m/min. The impregnated cloth was dried at a temperature of 30° C. to 85%, e.g. by passing over heater rolls 20 so as to eliminate the water from the impregnation composition, and was then passed through an omega-type traction system 21 prior to being wound onto a reel 22 for storage for about 24 h.

The impregnated cloth was taken from the reel 22 by means of an omega-type traction system 24 (FIG. 1B) passing via a jumper roller 26 serving to keep tension constant throughout the process.

The cloth was passed through a sealing box 32 and a waste removal box 34 situated ahead of the inlet to a heat treatment oven 30. At the outlet from the oven, the cloth was passed through a waste removal box 36 and a sealing box 38.

The sealing boxes 32 and 38 had a transverse flow of nitrogen at positive relative pressure passing therethrough. The waste removal box 34 fixed to the upstream wall of the oven had a pipe 35 penetrating its wall to enable the inside volume of the oven to be fed with nitrogen, the heat treatment being performed under an inert atmosphere. The waste removal box 36 was fixed to the downstream wall of the oven 30. The boxes 34 and 36 had outlets 34*a* and 36*a* for removing waste gases. Screens 40 suitable for allowing the strip of cloth to pass therethrough, were provided at the inlet and at the outlet of the oven 30 so as to limit thermal radiation out from the oven.

Figure 2:
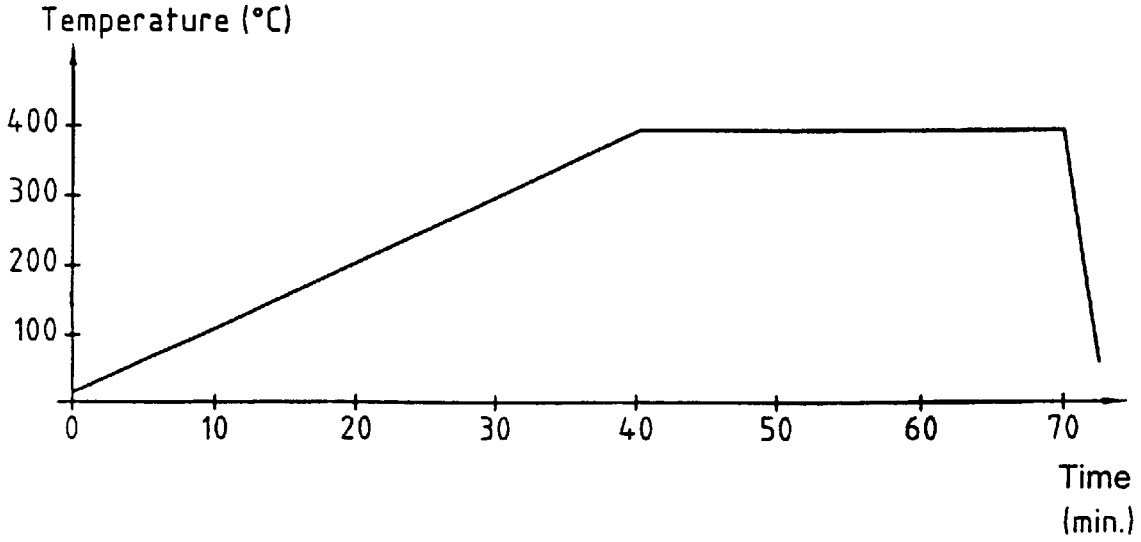
FIG. 2 is a graph showing the temperature profile of the heat treatment oven shown in FIG. 1B.

In the oven 30, the cloth passed through a quartz tube 30*a* resting on a ladder 30*b*, likewise made of quartz. The working length of the quartz tube was about 1.3 m. The oven 30 had a plurality of heating zones, e.g. four successive zones I, II, III, and IV, and heating was controlled in such a manner that the cloth reached a temperature of about 400° C. about 40 minutes after entering the oven, with its temperature rising progressively, and remained at said temperature for about 30 min before leaving the oven. FIG. 2 shows the temperature profile in the oven as a function of time spent in the oven. The rate at which the temperature rose up to 400° C. was about 10° C./min.

On leaving the sealing box 38, the cloth was passed over a roller 42 (FIG. 1C) associated with a strain gauge, enabling tension on the cloth to be measured.

Thereafter, the cloth penetrated into a washing station comprising a vessel 50 subdivided into two compartments, an upstream compartment 50*a* and a downstream compartment 50*b*. Prior to entering the upstream compartment 50*a*, the cloth was sprayed with softened water by means of flat jet nozzles 52 feeding the compartment 50*a* within which excess ingredients of the impregnation composition still present on the cloth were solubilized. Thereafter the cloth passed into the compartment 50*b* where it was rinsed using demineralized water sprayed onto the cloth by means of nozzles 54 situated at the outlet from the compartment 50*b*, and above it.

The washed cloth was passed through an omega-type traction system 56 in which it was also subjected to wringing, prior to being dried at a temperature of about 120° C. by passing between two radiant plates 58. The drive speed of the traction system 56 was selected to be slightly greater than that imparted by the traction system 24 so as to take account of the cloth shrinking during carbonization.

This example is to be found in row M of Table 2 below. An activated cloth of carbon fibers was obtained having a specific surface area of about 1000 $m^2/g$ and a breaking strength both in the warp direction and in the weft direction of about 1 daN/cm.

EXAMPLES 14 to 16

The procedure was the same as in Example 13, but various parameters were varied: phosphoric acid content, speed of temperature rise, duration of constant temperature heat treatment.

Examples 14 to 16 appear in rows N to P of Table 2. In this table, the phosphoric acid content is the ratio of the mass of pure acid fixed on the cloth after impregnation to the mass of dry cloth prior to impregnation, and traction strength is expressed as traction strength in the warp direction.

TABLE 2

| Activated cloth | $H_3PO_4$ content % | Heat treatment | Specific surface area $m^2/g$ | Traction strength daN/cm |
|---|---|---|---|---|
| M | 17 | 10° C./min 400° C., 1/2 h | 1000 | 1 |
| N | 1 to 7 | 10° C./min 400° C., 1/2 h | 150 to 250 | 5.2 |
| O | 17 | 0.01° C./min to 0.1° C./min 400° C., 1/2 h | 200 | 1.1 |
| P | 17 | 10° C./min 400° C., 2 h to 12 h | 170 to 130 | 0.9 |

The results obtained with cloth N show that a small quantity of phosphoric acid is insufficient for creating significant microporosity. With reference also to cloths J, X, and L of Table 1, it can be considered that the phosphoric acid content should preferably lie in the range 10% to 22%. It can be seen that a small quantity of phosphoric acid gives rise to an increase in strength: the structure of the carbon is closed which goes against the object of obtaining an array of pores.

The results obtained with cloth O show that a very slow speed of temperature rise does not enable satisfactory porosity to be obtained. Observing the results obtained with cloths F, G, H, and I of Table 1, it can be seen that the mean speed of temperature rise should lie in the range 1° C./min to 15° C./min, and preferably in the range 1° C./min to 10° C./min, if it is desired to avoid penalizing strength (cloth I).

The results obtained with cloth P show that too long a time spent at the constant temperature leads to the previously-developed micropores becoming substantially closed. That is why it is preferable to limit the duration of the treatment at constant temperature to no more than 1 h.

To interpret the results of Table 2 concerning specific surface area, it is relevant to observe that carbon obtained from a cellulose precursor "naturally" presents a specific surface area of 50 $m^2/g$ to 150 $m^2/g$ (i.e. does so without activation) for carbonization heat treatment at temperatures below 1300° C. Consequently, with cloths N, O, and P, no very significant activation is observed beyond that of the "natural" microporosity.

Examples 17 to 20

The procedure was the same as in Example 13, but using different substances for impregnating the rayon cloth, respectively: phosphoric acid, a mixture of phosphoric acid and sodium borate, ammonium chloride, and dibasic ammonium phosphate.

The results obtained are given in rows Q to T of Table 3. The contents given in % present ratios between the mass of pure impregnation substance fixed on the cloth and the mass of dry cloth prior to being impregnated.

TABLE 3

| Activated cloth | Ingredient of impregnation composition | Specific surface area $m^2/g$ | Traction strength daN/cm |
|---|---|---|---|
| Q | $H_3PO_4$ (17%) | 1005 | 0.7 |
| R | $H_3PO_4$ (17%) + $Na_2B_4O_7$ (1.5%) | 1020 | 2.7 |
| S | $NH_4Cl$ (25%) | 350 | 3.1 |
| T | $(NH_4)_2HPO_4$ (20%) | 540 | 0.9 |

In addition to being of low cost, phosphoric acid has the advantage of presenting three acid functions for promoting dehydration of cellulose, and compared with $NH_4Cl$ and $(NH_4)_2HPO_4$, of requiring concentration that is lower in order to obtain the desired porosity.

With $NH_4Cl$ and $(NH_4)_2HPO_4$, a significantly higher concentration is necessary to obtain a specific surface area of the same order as that obtained with $H_3PO_4$.

Thus, the use of phosphoric acid, possibly mixed with other ingredients, is preferred, but that does not exclude other inorganic ingredients known as promoters of dehydration in cellulose.

EXAMPLES 21 to 25

The procedure was the same as in Example 13, but different cellulose precursors were used, respectively: textile type rayon I which naturally contains additives such as aluminum and titanium dioxide in its structure, which is a highly disoriented crystalline structure; rayon II which is an intermediate between textile rayon and technical rayon; technical rayon III of the type used for reinforcing tires; "solvent spun cellulose" type rayon IV; and spun viscose V commonly used in the textile industry. The results obtained are given in rows U to Y of Table 4.

TABLE 4

| Activated cloth | Type of precursor | Specific surface area $m^2/g$ | Traction strength daN/cm |
|---|---|---|---|
| U | Rayon I | 1310 | 1.5 |
| V | Rayon II | 1010 | 3.1 |
| W | Rayon III | 1145 | (rigid and brittle) |
| X | Rayon IV | 750 | (brittle) |
| Y | Spun viscose V | 1030 | 0.2 (flexible) |

These results show that it is preferable to use precursors of the textile rayon type or of the spun viscose type if it is desired to obtain satisfactory strength (cloths U, V, and Y).

What is claimed is:

1. A method of making an activated fabric of carbon fibers, the method comprising the steps that consist in providing a fabric of fibers of a carbon-precursor cellulose material, impregnating the fabric with a composition containing at least one inorganic ingredient having a function of promoting dehydrating of cellulose, and performing heat treatment on the impregnated fabric at a temperature which is sufficient to cause the precursor cellulose to be transformed essentially into carbon, and obtaining a fabric of carbon fibers; the method being characterized in that the heat treatment consists n raising temperature at a speed lying in the range 1° C./min to 15° C./min followed by keeping the temperature constant in the range 350° C. to 500° C., and followed by a step of washing the fabric, thereby directly obtaining an activated fabric of carbon fibers having a specific surface area of not less than 600 $m^2/g$, without subsequent activation treatment at a higher temperature.

2. A method according to claim 1, characterized in that the duration of the constant temperature heat treatment as not more than 1 h.

3. A method according to claim 1, characterized in that the heat treatment is performed under an inert atmosphere.

4. A method according to claim 1, characterized in that the heat treatment is performed under a partially-oxidizing atmosphere.

5. A method according to claim 1, characterized in that the carbon precursor cellulose material is selected from the group consisting of rayons, spun viscose, solvent spun celluloses, cotton, and bast fibers.

6. A method according to claim 1, characterized in that the carbon precursor cellulose material is selected from textile rayons and spun viscose.

7. A method according to claim 1, characterized in that the composition for impregnating the fabric of cellulose material fibers contains at least one inorganic ingredient and solid fillers.

8. A method according to claim 7, characterized in that the inorganic fillers are selected from the group consisting of antimony, iron, titanium, and silicon.

9. A method according to claim 1, characterized in that the steps of heat treatment and of washing are performed continuously on the fiber fabric.

10. A method according to claim 1, characterized in that the washing is performed in water and comprises a first stage of solubilizing any excess ingredient of the impregnation composition, and a second stage of rinsing.

11. A method according to claim 1, characterized in that the fabric of cellulose material fibers is impregnated with a composition containing at least phosphoric acid, in such a manner that the mass of pure phosphoric acid fixed on the fabric lies in the range 10% to 22% of the mass of the fabric in the dry state.

12. A method according to claim 2, characterized in that:

the heat treatment is performed under an atmosphere selected from the group consisting of an inert atmosphere and a partially oxidizing atmosphere;

the carbon precursor cellulose material is selected from the group consisting of rayons, textile rayons, spun viscose, solvent spun celluloses, cotton, and bast fibers;

the composition of the liquid for impregnating the fabric of cellulose material fibers contains at least one inorganic ingredient and solid fillers;

the inorganic fillers are selected from the group consisting of antimony, iron, titanium, and silicon;

the steps of heat treatment and of washing are performed continuously on the fiber fabric;

the washing is performed in water and comprises a first stage of solubilizing any excess ingredient of the impregnation composition, and a second stage of rinsing; and the fabric of cellulose material fibers is impregnated with a composition containing at least phosphoric acid, in such a manner that the mass of pure phosphoric acid fixed on the fabric lies in the range 10% to 22% of the mass of the fabric in the dry state.

* * * * *